United States Patent [19]

Kawahara et al.

[11] Patent Number: 4,911,063

[45] Date of Patent: Mar. 27, 1990

[54] HYDRAULICALLY OPERATED SWASH-PLATE APPARATUS

[75] Inventors: Eiichiro Kawahara; Takashi Nakamura; Takeo Suzuta, all of Saitama, Japan

[73] Assignee: Honda Giken Kogyo Kabushiki Kaisha, Tokyo, Japan

[21] Appl. No.: 132,468

[22] Filed: Dec. 14, 1987

[30] Foreign Application Priority Data

Dec. 12, 1986 [JP] Japan ..... 61-191430

[51] Int. Cl.[4] ..... F01B 3/00; F01B 13/04

[52] U.S. Cl. ..... 92/12.2; 92/71; 92/169.1; 74/60; 91/505; 91/506

[58] Field of Search ..... 92/70, 12.2, 161, 169.2, 92/169.3, 71, 150, 151; 91/504, 505, 506; 74/60

[56] References Cited

U.S. PATENT DOCUMENTS

| | | | |
|---|---|---|---|
| 26,519 | 1/1869 | D'Amato | 91/505 |
| 32,373 | 3/1887 | Bobier | 91/506 |
| 1,800,929 | 4/1931 | Craig | 74/60 |
| 2,190,812 | 2/1940 | Wahlmark | 92/12.2 |
| 2,272,771 | 2/1942 | Hawley | 91/505 |
| 2,546,583 | 3/1951 | Born . | |
| 3,108,544 | 10/1963 | Pesce | 91/505 |
| 3,133,418 | 5/1964 | Froebe . | |
| 3,143,933 | 8/1964 | Norton | 92/169.2 |
| 3,190,232 | 6/1965 | Budzich . | |
| 3,422,767 | 1/1969 | McAlvay | 91/505 |
| 3,464,206 | 9/1969 | Badalini . | |
| 3,738,232 | 6/1973 | Kadd | 92/169.2 |
| 3,739,691 | 6/1973 | Bobier . | |
| 3,866,518 | 5/1975 | Miyao | 91/488 |
| 4,444,093 | 4/1984 | Koga | 91/488 |
| 4,478,134 | 8/1984 | Kawahara | 91/488 |
| 4,646,520 | 3/1987 | Furumoto | 60/469 |
| 4,735,050 | 4/1988 | Hayashi | 60/489 |
| 4,741,251 | 5/1988 | Hayashi | 92/57 |
| 4,745,748 | 5/1988 | Hayashi | 60/489 |
| 4,748,898 | 6/1988 | Hayashi | 92/12.2 |

FOREIGN PATENT DOCUMENTS

| | | | |
|---|---|---|---|
| 0186500 | 2/1986 | European Pat. Off. . | |
| 860227 | 9/1939 | France | 92/12.2 |
| 55-27556 | 2/1980 | Japan . | |
| 57-76357 | 5/1982 | Japan . | |
| 57-79068 | 5/1982 | Japan . | |
| 59-38467 | 9/1984 | Japan . | |
| 61-153057 | 7/1986 | Japan . | |
| 40385 | 3/1942 | Netherlands | 74/60 |
| 933898 | 8/1963 | United Kingdom | 92/169.2 |
| 1021873 | 3/1966 | United Kingdom . | |

*Primary Examiner*—Robert E. Garrett
*Assistant Examiner*—Thomas Denion
*Attorney, Agent, or Firm*—Lyon & Lyon

[57] ABSTRACT

A hydraulically operated swash-plate apparatus includes a cylinder block rotatably supported in a case and having a plurality of axial cylinders arranged in an annular pattern, the case having an end plate for bearing a thrust load from the cylinder block, a plurality of plungers received respectively in the cylinders, a swash plate supported in the case by trunnions and slidably held against the free ends of the plungers, an actuator for tilting the swash plate, the plungers being movable into and out of the respective cylinders by a stroke which is variable according to the angle of inclination of the swash plate, a support member by which the trunnions are rotatably supported, and a tension member coupling the end plate and the support member to each other. The apparatus also includes a stopper mounted in the case for engaging a back of the swash plate to limit the maximum angle of inclination of the swash plate.

14 Claims, 3 Drawing Sheets

FIG. 2
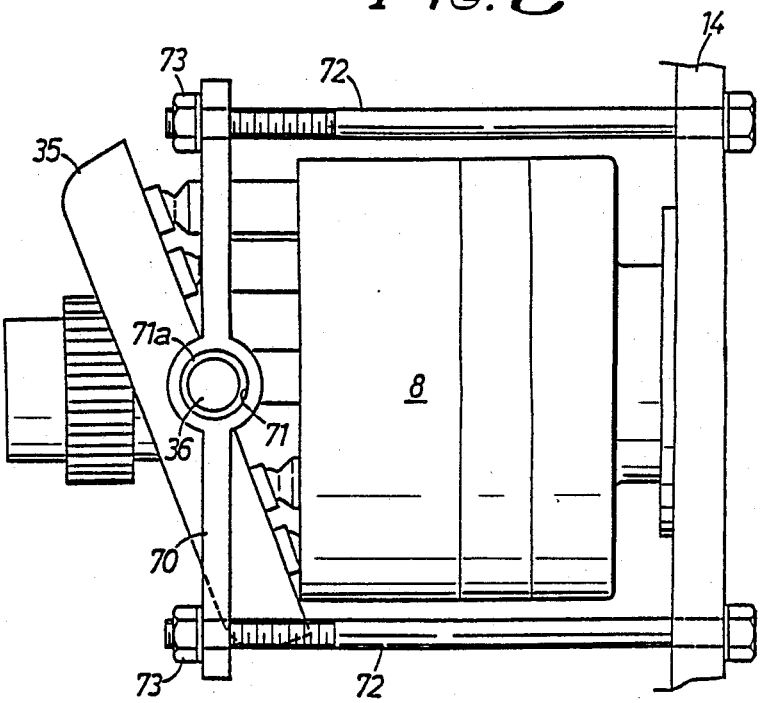
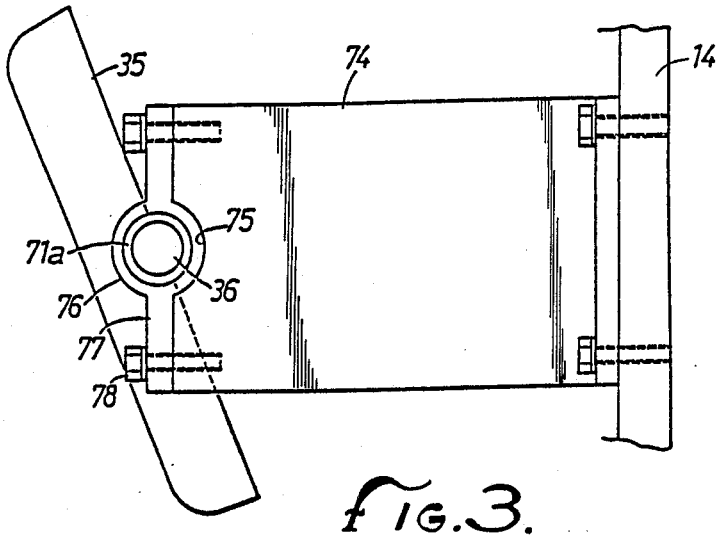
FIG. 3.

HYDRAULICALLY OPERATED SWASH-PLATE APPARATUS

BACKGROUND OF THE INVENTION

The present invention relates to a hydraulically operated swash-plate apparatus such as a hydraulically operated continuously variable transmission including a hydraulic pump and a hydraulic motor which ar interconnected by a closed hydraulic circuit, and more particularly to a shoe structure in such a hydraulically operated swash-type apparatus.

There have been known hydraulically operated swash-type apparatus such as hydraulically operated swash-plate apparatus including a cylinder block rotatably supported in a case and having a plurality of axial cylinders arranged in an annular pattern, plungers receive respectively in the cylinders, a swash plate supported in the case and slidably held against the free ends of tee plungers, and an actuator for tilting the swash plate, the stroke by which the plungers can move into and out of the respective cylinders being variable according to the angle of inclination of the swash plate. One known such arrangement is disclosed in Japanese Laid-Open Patent Publication No. 55-27556.

When the known hydraulically operated swash-plate apparatus is operated as either a pump or a motor, a thrust force acts between the free ends of the plungers and the swash plate. The swash plate and the cylinder block are supported by different case members. Since the case is subject to a relatively large tension during operation, the structure of the case must be mechanically strong enough to withstand such a tension. The case is generally made of cast iron or aluminum, and is of a large thickness in order to withstand the tension it suffers. As a result, the apparatus is large in size and heavy.

SUMMARY OF THE INVENTION

In view of the aforesaid drawback of the prior art, it is an object of the present invention to provide a hydraulically operated swash-plate apparatus which is designed to reduce the tension applied to a case thereof, thus reducing the size and weight of the apparatus.

According to the present invention, the above object can be accomplished by a hydraulically operated swash-plate apparatus including a case, a cylinder block rotatably supported in the case and having a plurality of axial cylinders arranged in an annular pattern, the case having an end plate for bearing a thrust load from the cylinder block, a plurality of plungers received respectively in the cylinders, a swash plate supported in the case by trunnions and slidably held against the free ends of the plungers, an actuator for tilting the swash plate, the plungers being movable into and out of the respective cylinders by a stroke which is variable according to the angle of inclination of the swash plate, a support member by which the trunnions are rotatably supported, add a tension member coupling the end plate and the support member to each other.

Because the thrust acting between the swash plate and the cylinder block is borne by the tension member, not the case, the load imposed on the case is reduced, and the case may be small in size and reduced in weight.

The above and other objects, features and advantages of the present invention will become more apparent from the following description when taken in conjunction with the accompanying drawings, in which preferred embodiments of the present invention are shown by way of illustrative example.

BRIEF DESCRIPTION OF THE DRAWINGS

FIG. 2 is a side elevational view of a structure by which a swash plate is supported in the apparatus shown in FIG. 1; and FIG. 3 is a view similar to FIG. 2, showing another embodiment of the present invention.

DESCRIPTION OF THE PREFERRED EMBODIMENTS

Figure 1:
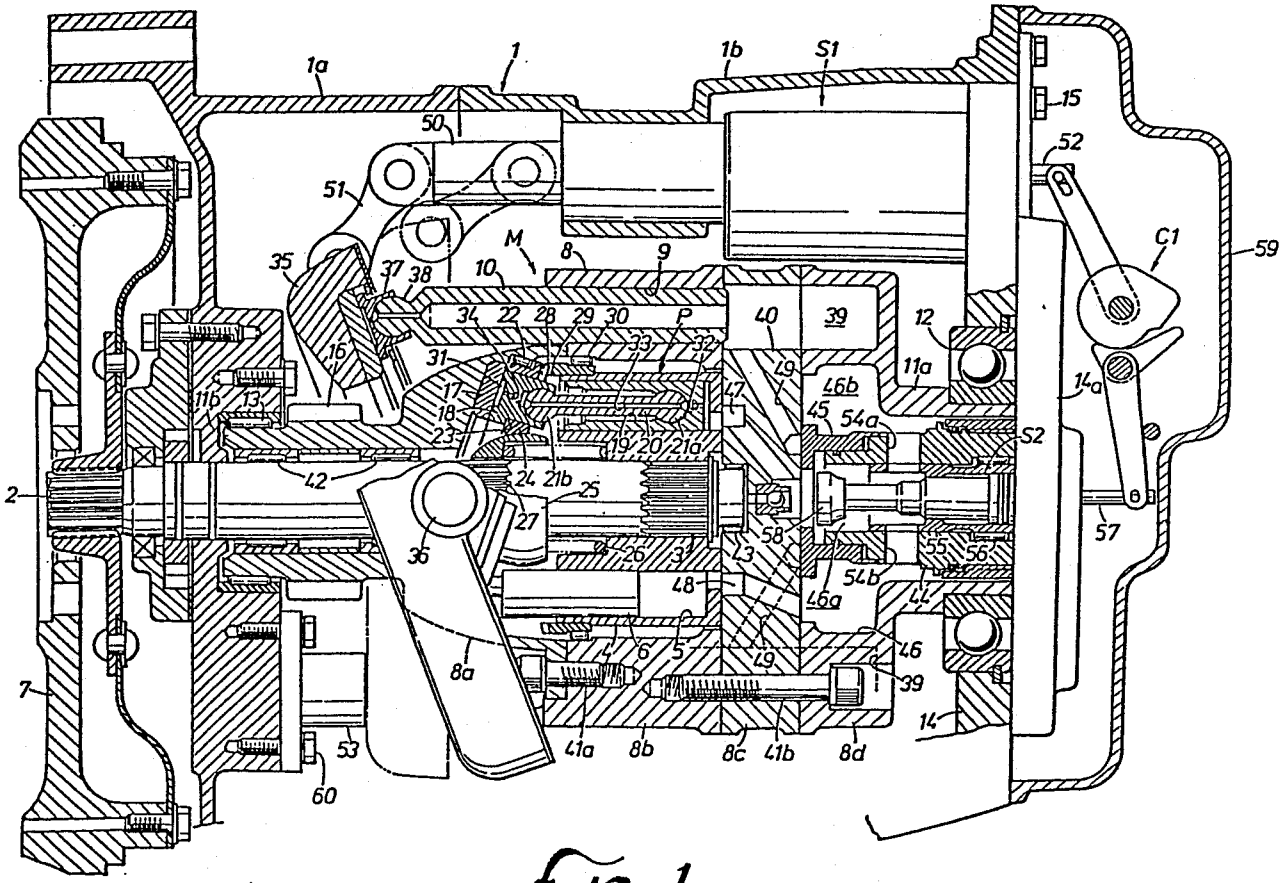
FIG. 1 is a longitudinal cross-sectional view of a hydraulically operated continuously variable transmission according to the present invention.

FIG. 1 shows a hydraulically operated continuously variable transmission for use in a motor vehicle such as an automobile according to the present invention, the transmission basically comprising a hydraulic pump P and a hydraulic motor M housed in a transmission case 1 composed of a pair of longitudinally separated case members 1*a*, 1*b*.

The hydraulic pump P has a pump cylinder 4 splined to an end 3 of an input shaft 2, a plurality of cylinder holes or bores 5 defined in the pump cylinder 4 in a circular pattern around and concentric with the input shaft 2 and extending parallel to the input shaft 2, and a plurality of pump plungers 6 slidably fitted respectively in the cylinder holes 5. The hydraulic pump P can be driven by the power of an engine (not shown) which is transmitted through a flywheel 7 coupled to the opposite end of the input shaft 2.

The hydraulic motor M has a motor cylinder 8 disposed in surrounding relation to the pump cylinder 4, a plurality of cylinder holes or bores 9 defined in the motor cylinder 8 in a circular pattern around and concentric with the input shaft 2 and extending parallel to the input shaft 2, and a plurality of motor plungers 10 slidably fitted respectively in the cylinder holes 9. The hydraulic motor M is rotatable relatively to the pump cylinder 4 in concentric relation thereto.

The motor cylinder 8 has axially opposite ends on which a pair of support shafts 11*a*, 11*b* is disposed, respectively. The support shaft 11*a*is rotatably supported on an axial end wall 14 of the case member 1*b* by means of a ball bearing 12, and the support shaft 11*b* is rotatably supported on the axial end wall of the case member 1*a* by means of a needle bearing 13. A holder plate 14*a* is fixed by bolts 15 to the axial end wall 14 of the case member 1*b*. The ball bearing 12 and the support shaft 11*a* are thus fixedly mounted on the case member 1*b* against axial movement. The other support shaft 11*b* has an integral spur gear 16 for transmitting output power of the hydraulic motor M through a differential gear mechanism (not shown) to an outside member.

A pump swash plate 17 inclined at an angle to the pump plungers 6 is fixedly disposed radially inwardly of the motor cylinder 8. An annular pump shoe 18 is rotatably slidably supported on an inclined surface of the pump swash plate 17.

Each of the pump plungers 6 has a bottomed hole 19 opening toward the pump swash plate 17. A connecting rod 20 inserted in the bottomed hole 19 is pivotally movable with respect to the pump plunger 6 by means of a ball joint 21*a* on the inner end of the connecting rod 20. The connecting rod 20 projects out of the corresponding pump plunger 6 from the bottomed hole 19, and is pivotally movable with respect to the pump shoe 18 by means of a ball joint 21*b* on the outer projecting end of the connecting rod 20.

The annular pump shoe 18 has its outer peripheral surface supported in the motor cylinder 8 by a needle bearing 22. The annular pump shoe 18 has an annular step 23 defined in its inner peripheral surface facing the pump plungers 6. A presser ring 24 riding in the annular step 23 presses the pump shoe 18 toward the pump swash plate 17 under the resiliency of a compression coil spring 26 disposed under compression around the input shaft 2 and acting on spring holder 25 held against the presser ring 24. The spring holder 25 is slidably fitted over splines 27 on the input shaft 2, and has a partly spherical surface contacting a complementary partly spherical surface of the presser ring 24. Therefore, the spring holder 25 is neatly held against the presser ring 24 for transmitting the resilient force from the spring 26 to the presser ring 24 irrespective of how the spring holder 25 and the presser ring 24 are relatively positioned.

Thus, the pump shoe 18 can be slidingly rotated in a fixed position on the pump swash plate 17 at all times.

The pump shoe 18 has a crown gear 28 on the end face thereof facing the pump cylinder 4, the crown gear 28 extending around the outer periphery of the pump shoe 18. A bevel gear 29, which has the same number of teeth as the crown gear 28, is fixed to the outer periphery of the pump cylinder 4, and held in mesh with the crown gear 28. When the pump cylinder 4 is driven to rotate by the input shaft 2, the pump shoe 18 is rotated in synchronism with the pump cylinder 4 through the meshing gears 28, 29. On rotation of the pump shoe 18, those pump plungers 6 which run along an ascending side of the inclined surface of the pump swash plate 17 are moved in a discharge stroke by the pump swash plate 17, the pump shoe 18, and the connecting rods 20, and those pump plungers 6 which travel along a descending side of the inclined surface of the pump swash plate 17 are moved in a suction stroke.

A needle bearing 30 is disposed between the outer peripheral surface of the bevel gear 29 and the inner peripheral surface of the motor cylinder 8. Therefore, concentric relative rotation of the pump cylinder 4 and the motor cylinder 8 is performed with increased accuracy.

The pump shoe 18 has hydraulic pockets 31 defined in its surface held against the pump swash plate 17 and positioned in alignment with the respective connecting rods 20. The hydraulic pockets 31 communicate with the respective oil chambers in the pump cylinder 4 through oil holes 32 defined in the pump plungers 6, oil holes 33 defined in the connecting rods 20, and oil holes 34 defined in the pump shoe 18. While the pump cylinder 4 is in operation, therefore, oil under pressure in the pump cylinder 4 is supplied to the hydraulic pockets 31 to apply a hydraulic pressure to the pump shoe 18 in a direction to bear the thrust force imposed by the pump plungers 6 on the pump shoe 18. Therefore, the oil supplied to the hydraulic pockets 31 serves to reduce the pressure under which the pump shoe 19 contacts the pump swash plate 17, and also to lubricate the mutually sliding surfaces of the pump shoe 18 and the pump swash plate 17.

A motor swash plate 35 is tiltably supported in the transmission case 1 by means of a pair of trunnions 36 projecting from opposite sides of the motor swash plate 35, which is held in confronting relation to the motor plungers 10. The motor swash plate 35 has an inclined surface on which there is slidably disposed a motor shoe 37 that is pivotally coupled to ball joints 38 on the outer ends of the motor plungers 10.

Each of the motor plungers 10 reciprocally moves in expansion and compression strokes while rotating the motor cylinder 8. The stroke of the motor plungers 10 can continuously be adjusted from zero to a maximum level by varying the angle of inclination of the motor swash plate 35 from a vertical position (shown by the two-dot-dash lines) in which the motor swash plate 35 lies perpendicularly to the motor plungers 10 to a most inclined position (shown by the solid lines).

The motor cylinder 8 comprises axially separate first through fourth members or segments 8*a* through 8*d*. The first member 8*a* includes the support shaft 11*b* and accommodates the pump swash plate 17. The second member 8*b* as guide holes in the cylinder holes 9, in which the motor plungers 10 are slidably guided, respectively. The third and fourth members 8*c*, 8*d* have oil chambers 39 in the cylinder holes 9, the oil chambers 39 being slightly larger in diameter than the guide holes in the cylinder holes 9. The third member 8*c* serves as a distribution member 40 having oil passages leading to the cylinder holes 5, 9, and the fourth member 8*d* includes the support shaft 11*a*. The first through fourth members 8*a*–8*d* are relatively positioned by knock pins, for example, inserted in their mating end faces, and are firmly coupled together by means of a plurality of bolts 41*a*, 41*b*.

The input shaft 2 has an outer end portion rotatably supported centrally in the support shaft 11*b* of the motor cylinder 8 by a needle bearing 42, and an inner end portion rotatably supported centrally in the distribution member 40 by a needle bearing 43.

The spring 26 is disposed under compression between the pump cylinder 4 and the spring holder 25 for pressing the pump cylinder 4 against the distribution member 40 to prevent oil from leaking from between the sliding surfaces of the pump cylinder 4 and the distribution member 40. The resilient force of the spring 26 is also effective in supporting the spring holder 25, the presser ring 24, the pump shoe 18, and the pump swash plate 17 firmly in the motor cylinder 8, as described above.

The support shaft 11*a* is of a hollow structure in which a fixed shaft 44 is centrally inserted. A distribution ring 45 is fitted over the inner end of the fixed shaft 44 in a fluid-tight manner through an O-ring therebetween. The distribution ring 45 has an axial end face held in sliding contact with the distribution member 40 eccentrically with respect to the center of rotation of the input shaft 2. The fourth member 8*d* of the motor cylinder 8 has an interior hollow space 46 which is divided by the distribution ring 45 into an inner oil chamber 46*a* and an outer oil chamber 46*b*.

The distribution member 40 has an outlet port 47 and an inlet port 48. The outlet port 47 provides fluid communication between the cylinder holes 5 that receive the pump plungers 6 operating in the discharge stroke and the inner oil chamber 46*a*. The inlet port 48 provides fluid communication between the cylinder holes 5 that receive the pump plungers 6 operating in the suction stroke and the outer oil chamber 46*b*. The distribution member 40 also has a number of communication ports 49 defined therein and through which the cylinder holes 9 of the motor cylinder 8 communicate with the interior space 46 in the fourth member 8*d*.

The communication ports 49 open into the interior space 46 at equally spaced locations on a circle around the axis of rotation of the hydraulic motor M. The distribution ring 45 is slidably held against the distribution member 40 in eccentric relation, as described above. Therefore, in response to rotation of the motor cylinder 8, the communication ports 49 are caused by the distribution ring 45 slidingly held against the distribution member 40 to successively communicate with the inner and outer oil chambers 46*a*, 46*b*.

Therefore, a closed hydraulic circuit is formed between the hydraulic pump P and the hydraulic motor M through the distribution member 40 and the distribution ring 45. When the pump cylinder 4 is driven by the input shaft 2, high-pressure working oil discharged by the pump plungers 6 in the discharge stroke flows from the outlet port 47, the inner oil chamber 46*a*, and the communication ports 49 communicating with the inner oil chamber 46*a* into the cylinder holes 9 receiving the motor plungers 10 which are in the expansion stroke, thereby imposing a thrust on these motor plungers 10.

Working oil discharged by the motor plungers 10 operating in the compression stroke flows through the communication ports 49 communicating with the outer oil chamber 46*b* and the inlet port 48 into the cylinder holes 5 receiving the pump plungers 6 in the suction stroke. Upon such circulation of the working oil, the motor cylinder 8 is driven by the sum of the reactive torque applied by the pump plungers 6 in the discharge stroke to the motor cylinder 8 through the pump swash plate 17 and the reactive torque received by the motor plungers 10 in the expansion stroke from the motor swash plate 35.

The transmission ratio of the motor cylinder 8 to the pump cylinder 4 is given by the following equation:

$$\text{Transmission ratio} = \frac{\text{Rotational speed of pump cylinder 4}}{\text{Rotational speed of motor cylinder 8}} = 1 + \frac{\text{Displacement of hydraulic motor } M}{\text{Displacement of hydraulic pump } P}$$

It can be understood from the above equation that the transmission ratio can be varied from 1 to a desired value by varying the displacement of the hydraulic motor M from zero to a certain value.

Since the displacement of the hydraulic motor M is determined by the stroke of the motor plungers 10, the transmission ratio can continuously be adjusted from 1 to a certain value by tilting the motor swash plate 35 from the vertical position to a certain inclined position.

A hydraulic ratio-changing servomotor S1 for tilting the motor swash plate 35 is disposed in an upper portion of the transmission case 1. The ratio-changing servomotor S1 has a piston rod 50 having an end projecting into the transmission case 1. The projecting end of the piston rod 50 is coupled to the motor swash plate 35 through a connector 51 and pivot pins. The servomotor S1 has a pilot valve 52, and the outer end of the pilot valve 52 projecting through the holder plate 14 is coupled to a cam mechanism C1. The motor swash plate 35 is remotely controlled by a control device (not shown) through the servomotor S1 and the cam mechanism C1.

The ratio-changing servomotor S1 is of the known type in which a piston therein is reciprocally operated in amplified movement by following the movement of the pilot valve 52 which is given by the control device. In response to operation of the servomotor S1, the motor swash plate 35 can continuously be angularly shifted or adjusted from the most inclined position indicated by the solid lines in FIG. 1 where the transmission ratio is maximum to the least inclined position indicated by the imaginary (two-dot-and-dash) lines where the transmission ratio is minimum.

A stopper 53 is interposed between the motor swash plate 35 and the end wall of the case member 1*a* for limiting the mechanical least inclined position of the motor swash plate 35.

The stopper 53 is fastened to an end plate of the case member 1*a* by means of bolts 60. By replacing the stopper 53 with one of a suitable thickness as required, the neutral position of the swash plate 35 can easily and freely be adjusted. Since the back surface of the swash plate 35 is not intended for any special purpose and its pressure bearing surface area can be sufficiently be large, the contacting surface of the stopper 53 and the swash plate 35 are not subject to rapid wear.

The fixed shaft 44 is of a hollow construction having a peripheral wall having radial connecting ports 54*a*, 54*b* through which the inner and outer oil chambers 46*a*, 46*b* communicate with each other. A cylindrical clutch valve 55 is fitted in the interior space of the fixed shaft 44 for selectively opening and closing the ports 54*a*, 54*b*, the clutch valve 55 being rotatable relatively to the fixed shaft 44 through a needle bearing 56. The clutch valve 55 serves as a clutch for selectively connecting and disconnecting the hydraulic pump P and the hydraulic motor M. The clutch valve 55 is operatively coupled to a clutch control unit (not shown). When the ports 54*a*, 54*b* are fully opened, the clutch is in an "OFF" position. When the ports 54*a*, 54*b* are partly opened, the clutch is in a "partly ON" position. When the port 54*a*, 54*b* are fully closed, the clutch is in an "ON" position. With the clutch OFF as shown, working oil discharged from the outlet port 54*a*, 54*b* and the outer oil chamber 46*b* directly into the inlet port 48, making the hydraulic motor M inoperative. When the clutch is ON, the above oil flow is shut off, and working oil is circulated from the hydraulic pump P to the hydraulic motor M, allowing hydraulic power to be transmitted from the hydraulic pump P to the hydraulic motor M.

A servomotor S2 for selectively making and breaking the hydraulic circuit is disposed centrally in the hollow clutch valve 55. The servomotor S2 is operatively coupled to the ratio-changing servomotor S1 through the cam mechanism C1. When a pilot valve 57 of the servomotor S2 which projects out from the holder plate 14 is pushed, a shoe 58 on the distal end of the servomotor S2 closes the open end of the outlet port 47 in the distribution member 40 for thereby cutting off the flow of working oil from the outlet port 47 into the inner oil chamber 46*a*.

With the oil flow thus cut off, the pump plungers 6 are hydraulically locked and the hydraulic pump P and the hydraulic motor M are directly connected to each other, so that the motor cylinder 8 can mechanically be driven by the pump cylinder 4 through the pump plungers 6 and the pump swash plate 17. The hydraulic pump P and the hydraulic motor M are directly interconnected in this manner when the motor swash plate 35 is vertically positioned for the minimum transmission ratio. In this transmission position, the efficiency of transmission of power from the input shaft to the output shaft is increased, and the thrust applied by the motor plungers 10 to the motor swash plate 35 is reduced, thus lessening the stresses on the bearings and other members.

The cam mechanism C1, the holder plate 14, and other members are covered with an end cover 59 attached to the righthand side end of the transmission case 1.

FIG. 2 shows a support structure for the swash plate 35 in the apparatus shown in FIG. 1. One of the trunnions 36 of the swash plate 35 is tiltably supported in a support hole 71 defined in a support member 70 through a needle bearing 71*a*, for example. Elongate bolts 72 are inserted axially through the end wall 14 of the case member 1*b* and have free ends extending through the opposite ends of the support member 70, with nuts 73 threaded over the free ends of the bolts 72. The other trunnion 36 is supported by the same structure as described in FIG. 2.

Therefore, the thrust acting between the swash plate 35 and the cylinder block 8 is borne as a tension force applied to the members including the trunnions 36, the support member 70, the bolts 72, and the end wall 14. Thus, no tension force is imposed on the case 1, but the bolts 72 bear the tension force produced.

FIG. 3 shows a support structure according to another embodiment of the present invention. A pair of plates 74 extending axially is fastened to the end wall 14 at its opposite sides by means of bolts. Each of the plates 74 has a support recess 75 defined centrally in its free end. The support recess 75 receives therein a bearing support 76 on the center of a support member 77 coupled to the free end of the plate 74 by means of bolts 78. One of the trunnion 36 of the swash plate 35 is rotatably supported by a needle bearing 71*a*, for example, fitted in the bearing support 76. The thrust acting between the cylinder block 8 and the swash plate 35 is borne by the plates 74 serving as tension members, so that the load can efficiently be borne by the support structure.

With the present invention, as described above, the thrust force acting between the swash plate and the cylinder block is borne by the tension members separate from the case. The load bearing structure can thus efficiently bear the load applied by the swash plate. The apparatus, particularly the case thereof, is small in size and reduced in weight.

Although certain preferred embodiments have been shown and described, it should be understood that many changes and modifications may be made therein without departing from the scope of the appended claims.

What is claimed is:

1. A hydraulically operated swash-plate apparatus comprising:

a case;

a cylinder block rotatably supported in said case and having a plurality of axial cylinders arranged in an annular pattern, said case having an end plate for bearing a thrust load from said cylinder block;

a plurality of plungers received respectively in said cylinders;

a swash plate supported in said case by trunnions and slidably held against the free ends of said plungers;

an actuator for tilting said swash plate, said plungers being movable into and out of the respective cylinders by a stroke which is variable according to the angle of inclination of said swash plate;

a support member by which said trunnions are rotatably supported; and a tension member coupling said end plate and said support member to each other.

2. A hydraulically operated swash-plate apparatus according to claim 1, wherein said tension member comprises at least one bolt fastening said end plate and said support member together.

3. A hydraulically operated swash-plate apparatus according to claim 1, wherein said tension member comprises at least one plate fastening said end plate and said support member together.

4. A hydraulically operated swash-plate apparatus according to claim 1:

further comprising a stopper mounted in said case for engaging a back of said swash plate to limit the maximum angle of inclination of said swash plate.

5. A hydraulically operated swash-plate apparatus according to claim 1, further comprising a stopper means interposed between said swash plate and an end wall of said case for limiting the least inclined position of said swash plate.

6. A hydraulically operated swash-plate apparatus according to claim 5, wherein said stopper means comprises a replaceable stopper.

7. A hydraulically operated swash-plate apparatus according to claim 6, wherein the least inclined position of said swash plate may be varied by varying the thickness of said replaceable stopper.

8. A hydraulically operated swash-plate apparatus according to claim 7, wherein the least inclined position of said swash plate is perpendicular to the axis of rotation of the cylinder block.

9. A hydraulically operated swash-plate apparatus comprising:

a case;

a cylinder block rotatably supported in said case and having a plurality of axial cylinders arranged in an annular pattern, said case having an end plate for bearing a thrust load from said cylinder block;

a plurality of plungers received respectively in said cylinders;

a swash plate supported in said case by trunnions and slidably held against the free ends of said plungers;

an actuator for tilting said swash plate, said plungers being movable into and out of the respective cylinders by a stroke which is variable according to the angle of inclination of said swash plate;

a support member by which said trunnions are rotatably supported, said support member being contained in said case; and a tension member coupling said end plate and said support member to each other.

10. A hydraulically operated swash-plate apparatus according to claim 9, wherein said tension member comprises at least one bolt fastening said end plate and said support member together.

11. A hydraulically operated swash-plate apparatus according to claim 9, wherein said tension member comprises at least one plate fastening said end plate and said support member together.

12. A hydraulically operated swash-plate apparatus comprising:

a case;

a hydraulic motor supported in said case;

a hydraulic pump supported in said case;

a cylinder block rotatably supported in said case and having a plurality of axial cylinders arranged in an annular pattern, said case having an end plate for bearing a thrust load from said cylinder block;

a plurality of plungers received respectively in said cylinders;

a swash plate supported in said case by trunnions and slidably held against the free ends of said plungers;

an actuator for tilting said swash plate, said plungers being movable into and out of the respective cylinders by a stroke which is variable according to the angle of inclination of said swash plate;

a support member by which said trunnions are rotatably supported; and a tension member coupling said end plate and said support member to each other.

13. A hydraulically operated swash-plate apparatus according to claim 12, wherein said tension member comprises at least one bolt fastening said end plate and said support member together.

14. A hydraulically operated swash-plate apparatus according to claim 12, wherein said tension member comprises at least one plate fastening said end plate and said support member together.

* * * * *